US005187529A

United States Patent [19]

Nakayama

[11] Patent Number: 5,187,529

[45] Date of Patent: Feb. 16, 1993

[54] DEVICE FOR COLLECTING A TONER CARRIER IN AN IMAGE DEVELOPING APPARATUS

[75] Inventor: Masayuki Nakayama, Hyogo, Japan

[73] Assignee: Mitsubishi Denki Kabushiki Kaisha, Tokyo, Japan

[21] Appl. No.: 386,113

[22] Filed: Jul. 28, 1989

[51] Int. Cl.[5] ..... G03G 15/09; G03G 21/00

[52] U.S. Cl. ..... 355/296; 355/245

[58] Field of Search ..... 355/245, 305, 251, 253, 355/296, 259, 298, 264, 269; 118/657, 658

[56] References Cited

U.S. PATENT DOCUMENTS

| | | | |
|---|---|---|---|
| 3,739,749 | 6/1973 | Kangas et al. | 118/637 |
| 3,950,089 | 4/1976 | Fraser et al. | 355/305 X |
| 4,086,873 | 5/1978 | Morita et al. | 118/658 |
| 4,374,191 | 2/1983 | Mukoh et al. | 430/100 |
| 4,422,749 | 12/1983 | Hoshino et al. | 355/251 |
| 4,469,427 | 9/1984 | Kopp et al. | 118/657 X |
| 4,487,496 | 12/1984 | Baier et al. | 355/253 |
| 4,526,130 | 7/1985 | Fukuda et al. | 118/657 |
| 4,533,235 | 8/1985 | Uchida | 118/652 |
| 4,671,641 | 6/1987 | Kohyama | 355/305 X |
| 4,766,468 | 8/1988 | Hosono et al. | 355/261 |

FOREIGN PATENT DOCUMENTS 0212880 9/1986 Japan .

*Primary Examiner*—A. T. Grimley
*Assistant Examiner*—Nestor R. Ramirez

[57] ABSTRACT

A device for collecting a carrier in an image developing apparatus upon developing with a two-component developer, wherein a carrier collecting magnet roll having an insulator surface thereon and a rotatable magnet portion therein, is positioned close to a photosensitive material, contacted by a scraper at the surface thereof, and driven by a driving motor, so that the carrier gathering on the roll even at the ends thereof does not cause any grounding of the developing bias applied to the developing apparatus due to the insulator surface of the roll. It is therefore possible to achieve a drastically improvement in printing quality.

1 Claim, 2 Drawing Sheets

| | UPON PRINTING STOP | UPON PAPER END | UPON TURN ON |
|---|---|---|---|
| EXAMPLE A | 1 ROTATION | 0 ROTATION | 1 ROTATION |
| EXAMPLE B | 2 ROTATIONS | 5 ROTATIONS | 2 ROTATIONS |

DEVICE FOR COLLECTING A TONER CARRIER IN AN IMAGE DEVELOPING APPARATUS

BACKGROUND OF THE INVENTION

1. Field of the Invention

This invention relates to a device for collecting a toner carrier in an image developing apparatus after an electrostatic latent image formed on a photosensitive material by, for example, electrophotography has been developed with a two-component magnetic brush.

2. Description of the Prior Art

A known device for collecting a toner carrier in an image developing apparatus is shown as a sectional view in FIG. 1. The developing apparatus has a main body 1 to which a developing bias is applied, and which contains a two-component developer not shown. The developer is composed of particles of a toner and particles of a magnetic carrier. A pair of stirring shafts 2 are provided in the main body 1 of the developing apparatus and are rotatable for stirring and mixing the two-component developer sufficiently and transporting it in two opposite directions which are perpendicular to the sheet of the drawing. The main body 1 has an opening in which the development of an image is carried out. A developing magnet roll 3 is rotatably disposed in the main body 1 adjacent to its opening and comprises a rotatable sleeve 3*b* which contains a plurality of stationary magnetic poles 3*a*. A doctor blade 4 is provided in the main body 1 near the developing magnet roll 3 for maintaining at a fixed level the quantity of the developer which is adsorbed by the surface of the roll 3 to form a magnetic brush, and thereby the length of the filaments of which the brush is composed. A photosensitive drum 5 is disposed in the opening of the main body 1 and has a surface covered with a layer of a photoconductive material which forms an electrostatic latent image when electrically charged and exposed to light by the electrophotographic (or Carlson) process. A carrier collecting magnet roll 6 is disposed in close proximity to the drum 5 and comprises an outer sleeve 6*a* and an inner magnet portion 6*b* which is rotatable. A scraper 7 is provided for contacting the sleeve 6*a* and scraping the carrier off its surface.

In operation, the two-component developer in the main body 1 of the developing apparatus is sufficiently stirred and mixed by the stirring shafts 2 and after it has been electrically charged, it is adsorbed to the surface of the sleeve 3*b* of the developing magnet roll 3 by the magnetic force of its stationary magnetic poles 3*a* and is conveyed upwardly with the rotation of the sleeve 3*b* in the direction of an arrow A in FIG. 1. The quantity of the developer adhering to the surface of the sleeve 3*b* is maintained at a uniform level by the doctor blade 4, so that the filaments of a magnetic brush formed by the developer on the surface of the sleeve 3*b* may keep a uniform length. As the roll 3 is rotated, the magnetic brush is rubbed against the surface of the photosensitive drum 5 and the toner adheres electrostatically to an electrostatic latent image which has been formed on the surface of the drum 5, whereby the image is developed. While the toner in the developer is transferred from the roll 3 to the surface of the drum 5, the carrier remains adherent to the roll 3 and is conveyed toward the stirring shafts 2. A part of the carrier, however, leaves the roll 3 by adhering to the drum 5, or scattering. The carrier adhering to the drum 5 becomes an obstacle to the subsequent process in which the toner image is transferred to recording paper, and causes a printing defect known as incomplete transfer. Therefore, the carrier adhering to the drum 5 is removed by the carrier collecting magnet roll 6 and the scraper 7 and is collected in the main body 1. The carrier on the photosensitive material is adsorbed to the surface of the sleeve 6*a* of the roll 6 by the magnetic force of its magnet portion 6*b*. When a cycle of developing operation is terminated, the magnet portion 6*b* of the roll 6 is rotated in the direction of an arrow B in FIG. 1 and the carrier is scraped off the sleeve 6*a* by the scraper 7, so that it may return into the main body 1.

A larger amount of carrier is, however, likely to scatter from the opposite ends of the magnetic brush on the developing magnet roll 3 beyond which no magnetic field exists, than from its middle portion. Accordingly, the carrier is more likely to gather at the opposite ends of the carrier collecting magnet roll 6 than in its middle portion. As the magnet portion 6*b* of the roll 6 does not extend to either end thereof, the carrier is less easy to convey about the opposite ends of the sleeve 6*a* than about its middle portion and can, therefore, be scraped off the sleeve 6*a* less effectively at its ends than in its middle portion.

A large amount of carrier is, therefore, likely to gather at the opposite ends of the carrier collecting magnet roll 6 and contact the conductor portion of the photosensitive drum 5, i.e. its portion not covered with the photoconductive material. The occurrence of any such contact results in the grounding of the developing bias which gives rise to a serious printing defect.

SUMMARY OF THE INVENTION

It is an object of this invention to provide a carrier collecting device for an image developing apparatus which enables the realization of a constantly high level of printing quality without causing any grounding of a developing bias, even if the carrier may gather at the opposite ends of a carrier collecting magnet roll.

It is another object of this invention to provide a carrier collecting device for an image developing apparatus which is far superior in performance to any conventionally known device of the same sort and yet is relatively inexpensive to manufacture.

It is still another object of this invention to provide a carrier collecting device for an image developing apparatus which is simple in construction and is dimensionally comparable to any conventionally known device.

These and other objects of this invention and its novel features will become more apparent from the following detailed description when it is read in conjunction with the accompanying drawings. It is, however, to be understood that the drawings are merely illustrative and are not intended for limiting the scope of this invention.

The foregoing objects are essentially attained by a device which comprises a carrier collecting magnet roll disposed in the vicinity of a photosensitive material, having an electrically insulated surface and containing a rotatable magnet portion, a scraper contacting the surface of the carrier collecting magnet roll, and means for rotating the roll.

Even if the carrier may gather at the ends of the carrier collecting magnet roll, there is no grounding of a developing bias, since the roll has an electrically insulated surface.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

Figure 1:
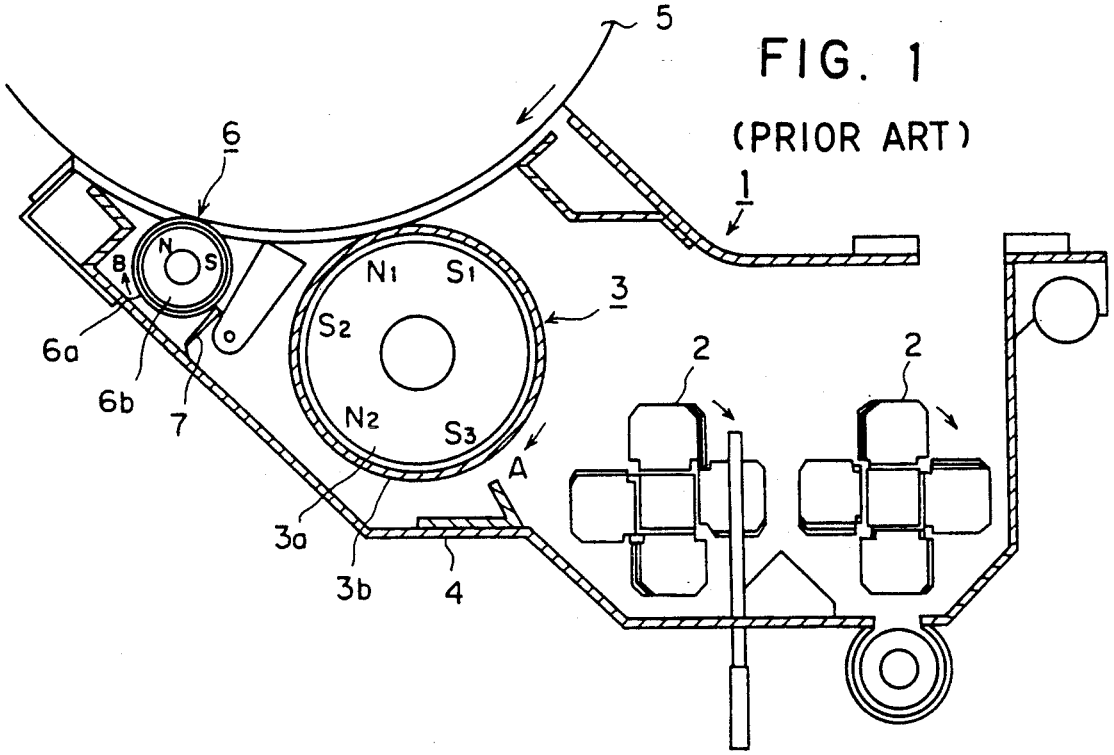
FIG. 1 (PRIOR ART)
FIG. 1 is a cross sectional view of a known carrier collecting device for an image developing apparatus.
Figure 2:
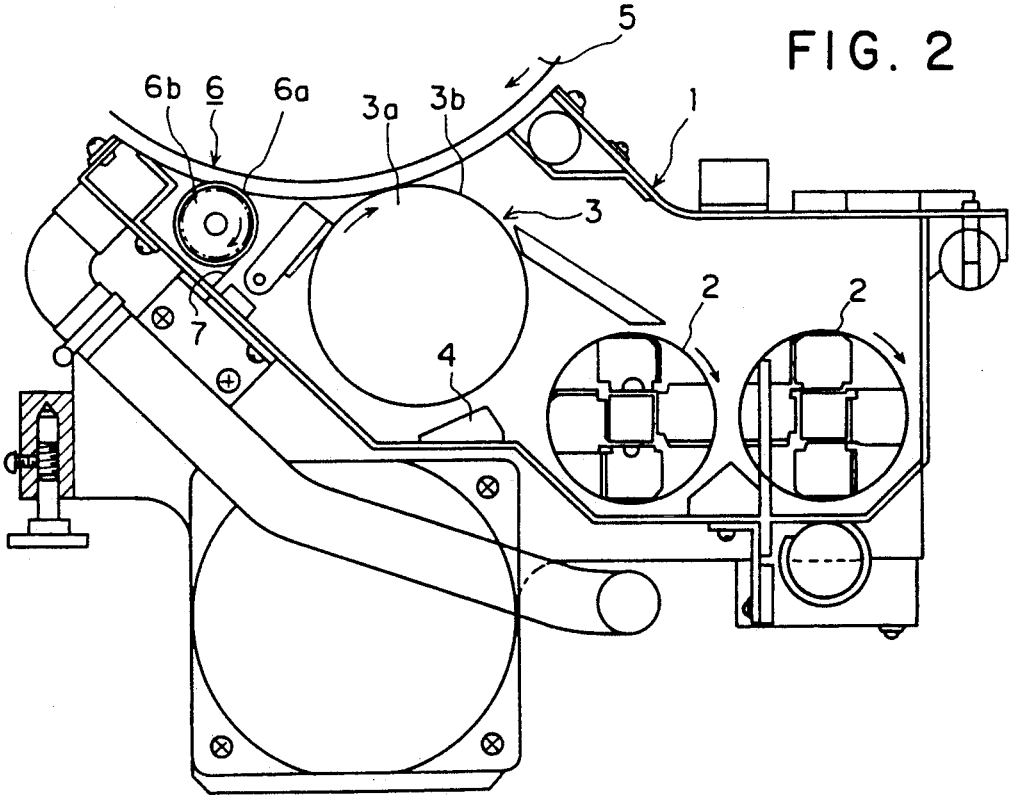
FIG. 2 is a cross sectional view of a carrier collecting device embodying this invention.
Figures 3, 4:
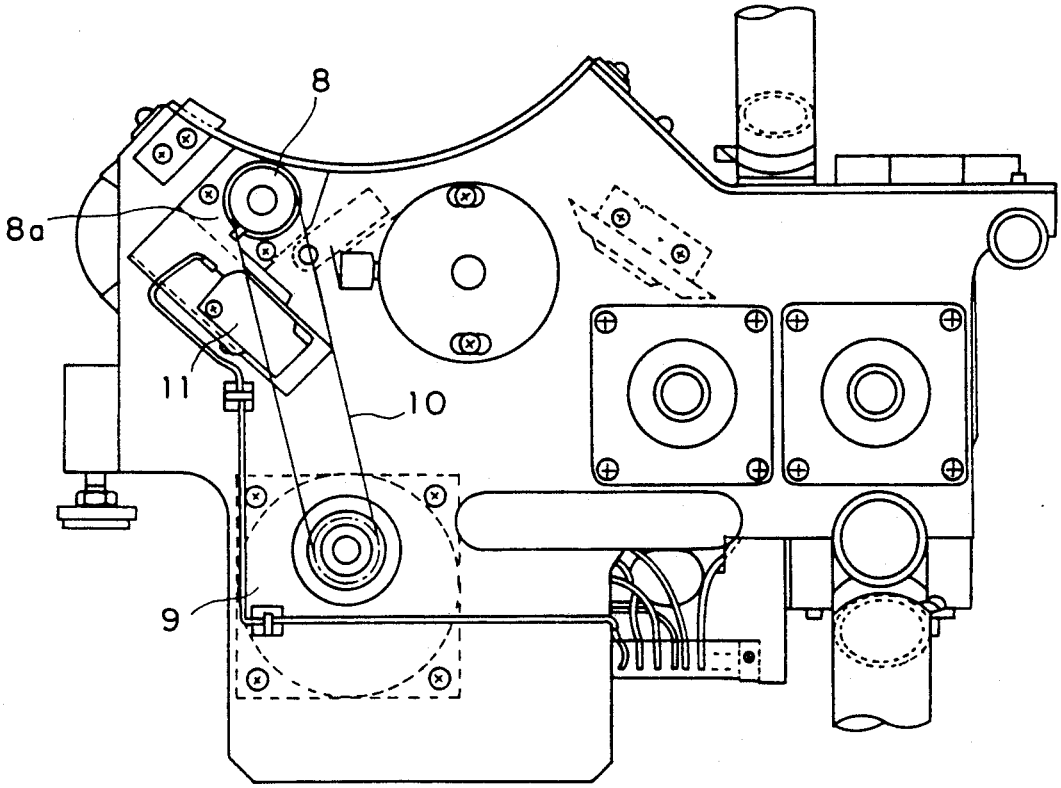
FIG. 3 is a side elevational view of the device shown in FIG. 2.
FIG. 4 is a chart showing the timing for the rotation of a carrier collecting magnet roll by way of example.

A carrier collecting device embodying this invention is shown in FIG. 2 and includes a driving mechanism which is shown in FIG. 3. The same reference numerals are used to indicate the same or corresponding parts in both of FIGS. 1 and 2. No repeated description is, therefore, made of any of those parts which are common to the devices shown in FIGS. 1 and 2 and have already been described with reference to FIG. 1.

According to one of the features which differentiate the device of this invention as shown in FIG. 2 from the known device, the carrier collecting magnet roll 6 includes a sleeve **6*a*** having an electrically insulated surface formed from e.g. Alumite.

Referring now to FIG. 3, a cam 8 is attached to a shaft on which the roll 6 is rotatably supported, and has a cut face **8*a* used for setting the timing with which the operation of a driving motor 9 is stopped, as will hereinafter be described in further detail. The motor 9 is placed in operation for rotating the magnet portion 6*b* of the roll 6 when the developing apparatus is out of printing operation. The output of the motor 9 is transmitted to the roll 6 by a chain 10. A microswitch 11 is provided in close proximity to the cam 8, so that upon abutting on the cut face 8*a* of the cam 8, it may be turned on to stop the operation of the motor 9**.

The carrier collecting magnet roll 6 stays at a standstill as long as the developing apparatus is used for any printing operation. The carrier adhering to the surface of the photosensitive drum 5 and the scattering carrier are adsorbed to the surface of the sleeve **6*a* of the roll 6 by the magnetic field formed by its magnet portion 6*b*. When the printing operation has been discontinued, the motor 9 is started and its rotation is transmitted by the chain 10 to the roll 6 to rotate its magnet portion 6*b*. As a result, the carrier on the sleeve 6*a* is caused to move around it and upon reaching a scraper 7, it is scraped off the sleeve 6*a* and collected in the main body 1 of the developing apparatus. As the magnet portion 6*b* is further rotated, the cam 8 is rotated therewith and when its cut face 8*a* has arrived at the microswitch 11, it is turned on to stop the rotation of the motor 9 and thereby of the magnet portion 6*b* of the roll 6. Then, the magnetic field which is directed toward the surface of the drum 5 is formed again by the magnet portion 6*b***.

A DC voltage of several tens to several hundred volts is applied as a developing bias to the main body 1 of the developing apparatus. Therefore, if the carrier gathering on the roll 6 forms a shortcircuit between the roll 6 and that portion of the surface of the drum 5 which is not covered with any photoconductive material, the developing bias is grounded, giving rise to a serious printing trouble. According to this invention, however, no such grounding can occur, even if the carrier may gather at the ends of the roll 6, since the sleeve **6*a*** defining its surface has an electrically insulated surface.

Although the surface of the sleeve **6*a* has been described as being formed from Alumite, it is also possible to use any other material, whether inorganic or organic, if it can form an insulator surface which can prevent the grounding of a developing bias. Although the chain 10 has been used for causing the rotation of the magnet portion 6*b* of the roll 6, it is possible to use any other means that is appropriate for that purpose. It is also possible to use any other means for detecting the position of the magnet portion 6*b* during its rotation, instead of the combination of the cam 8 and the microswitch 11** which has been described.

Various patterns are available for the timing with which the carrier collecting magnet roll 6 is rotated. A couple of examples are shown in FIG. 4. According to the pattern of Example A, the roll 6 is rotated only once when the printing operation has been stopped. According to the pattern of Example B, it is rotated twice when the printing operation has been stopped, as well as when a power source switch has been turned on, and is also rotated five times when printing paper has been used out. The latter pattern is particularly useful for the roll 6 provided in, for example, a printer in which printing is made on a fold type strip chart. It enables the still more effective removal of the carrier which is more likely to gather at the ends of the roll 6 than in its middle portion, as hereinbefore stated.

Although the device has been described as including the roll 6 having the magnet portion **6*b* which stays at a standstill during the printing operation and is rotated for the removal of the carrier from the sleeve 6*a*** when the printing operation has been stopped, it is alternatively possible to employ a carrier collecting magnet roll having a rotatable sleeve which is rotated throughout the printing operation, while its magnet portion is stationary.

As is obvious from the foregoing description, the device of this invention ensures that the carrier gathering on the carrier collecting magnet roll even at the ends thereof does not cause any grounding of the developing bias giving rise to a serious printing trouble, as the roll has an electrically insulated surface, and enables, therefore, a drastic improvement in the quality of printing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for collecting a carrier in an image developing apparatus to which a developing bias is applied, and in which a developing magnet roll having a surface to which a two-component developer composed of a toner and its carrier has been absorbed is rotated to cause said toner to develop an electrostatic latent image on a photosensitive material, said device comprising:

a carrier collecting magnet roll located close to said photosensitive material, and having a sleeve with an insulator surface and a magnet portion surrounded by said sleeve, said magnet portion being rotated in a timed pattern, and said sleeve of the carrier collecting magnet roll being stopped during developing;

a scraper contacting the surface of said carrier collecting magnet roll; and driving means for rotating said carrier collecting magnet roll.

* * * * *